United States Patent [19]

Kuki et al.

[11] Patent Number: 4,905,413

[45] Date of Patent: Mar. 6, 1990

[54] POWER WINDOW REGULATING DEVICE

[75] Inventors: Nobuyuki Kuki, Toyohashi; Hirokazu Suzumura, Toyota, both of Japan

[73] Assignee: Aisin Seiki Kabushiki Kaisha, Kariya, Japan

[21] Appl. No.: 250,636

[22] Filed: Sep. 29, 1988

[30] Foreign Application Priority Data

Sep. 30, 1987 [JP] Japan ..... 62-245970

[51] Int. Cl.[4] ..... E05F 11/42

[52] U.S. Cl. ..... 49/362; 49/348; 49/375

[58] Field of Search ..... 49/349, 362, 374, 375, 49/348

[56] References Cited

U.S. PATENT DOCUMENTS

| | | | |
|---|---|---|---|
| 2,115,632 | 5/1938 | Hanley | 49/348 |
| 3,449,861 | 6/1969 | Lecomte | 49/358 |
| 3,706,167 | 12/1972 | Pickles | 49/348 |
| 4,167,834 | 9/1979 | Pickles | 49/358 |

*Primary Examiner*—Kenneth J. Dorner
*Assistant Examiner*—Gerald D. Anderson
*Attorney, Agent, or Firm*—Finnegan, Henderson, Farabow, Garrett and Dunner

[57] ABSTRACT

This invention relates to a power window regulating device including a bracket fixed to a lower portion of a window glass, an electric motor fixed to the bracket, a speed reduction member connected to an output shaft of the motor, and a guide member fixed to a vehicle body side and vertically extended and engaged with an output side of the speed reduction member, whereby up- and downwardly moving the window glass along the guide member by the electric motor.

6 Claims, 4 Drawing Sheets

POWER WINDOW REGULATING DEVICE

BACKGROUND OF THE INVENTION

1. Field of the Invention

This invention relates to a power window regulating device, and more particularly to a power window regulating device for vehicles in order to electrically open and close the window.

2. Description of the Prior Art

A conventional power window regulating device is shown in FIG. 5 wherein front and rear sides of a window glass 2, guided by a door frame 1 are slid up and down. A bracket 4 provided with a groove 3 which is horizontally extended is fixed to a lower portion of the window glass 2. A pair of links 5, 6 having a cross-shape are located along a door panel and shoes pivotably mounted on a upper end portion of the links 5, 6 are slidable in the groove 3. A shoe which is pivotably mounted on a lower portion of the link 6 is slidably provided in a groove 7 of the door panel. A lower portion of the link 5 is pivotably mounted on the door panel through a pin 8. A sector gear 9 of the link 5 is engaged with a worm wheel 10 which is engaged with a worm gear of a motor 11. The rotation of the motor 11 is transmitted to the sector gear 9 through the worm wheel 10, therefore, the link 5 is rotated around the pin 8 and the shoes of the upper end portion of the links 5, 6 slide relative eachother by approaching or separating in the groove 3, and the window glass 2 is moved up or down.

However, the link mechanism between the motor and the window glass is necessary in the conventional power window regulating device in order to attain the abovementioned function. Accordingly, a space is required for the door panel for maintaining the operation of the links and the thickness of the door must be increased for the space. Further, a reverse load on the motor is increased in accordance with a link ratio, so that it is necessary to design a large worm gear and a large space in the door panel for the worm gear.

SUMMARY OF THE INVENTION

It is an object of this invention to provide a power window regulating device whicih can be used with a thin door.

It is another object of the invention to provide a power window regulating device in which a complicated link mechanism is not required.

In order to accomplish the objects, a power window regulating device includes a bracket which is fixed to a lower portion of a window glass, an electric motor which is fixed to the bracket, a speed reduction member which is connected to an output shaft of the motor, a guide member which is fixed to a vehicle body side and is engaged with an output side of the speed reduction device, and means for up- and downwardly moving the window glass along the guide member.

BRIEF DESCRIPTION OF THE DRAWINGS

Other and further objects of features and advantages of the present invention will be understood more clearly fully from the detailed description of preferred embodiment with reference with the attached drawings.

DETAILED DESCRIPTION OF THE INVENTION

Figure 1:
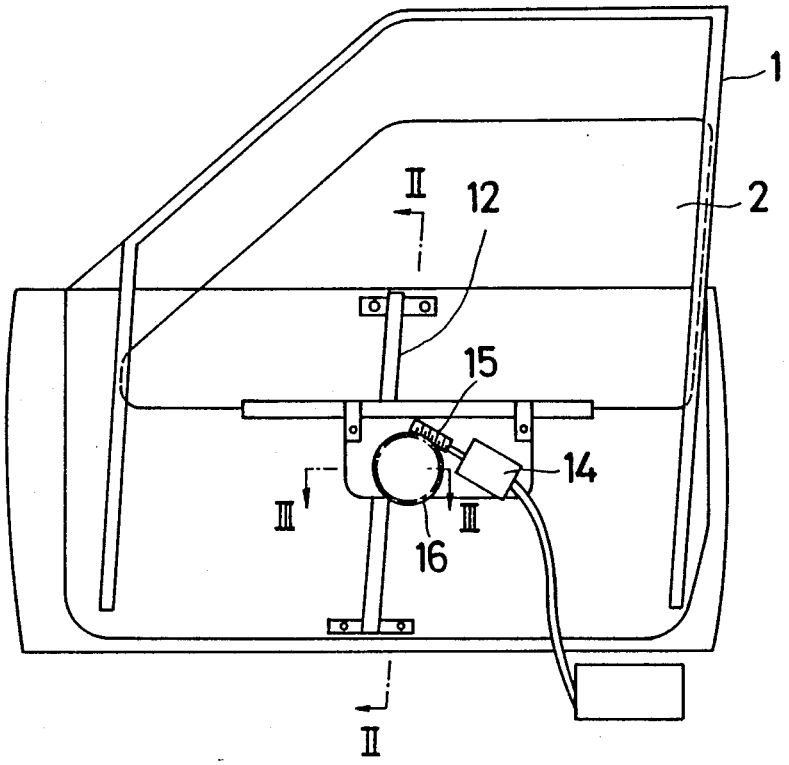
FIG. 1 is a front view of a power window regulating device of the present invention.
Figure 2:
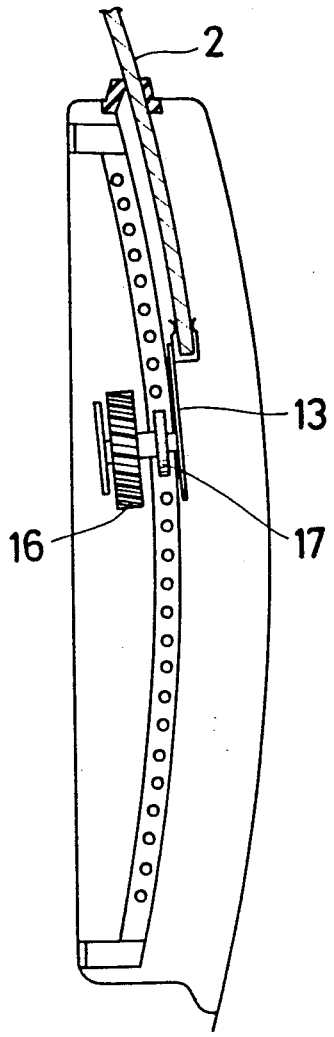
FIG. 2 is a sectional view of the power window regulating device which is taken along the line II—II in FIG. 1.
Figure 3:
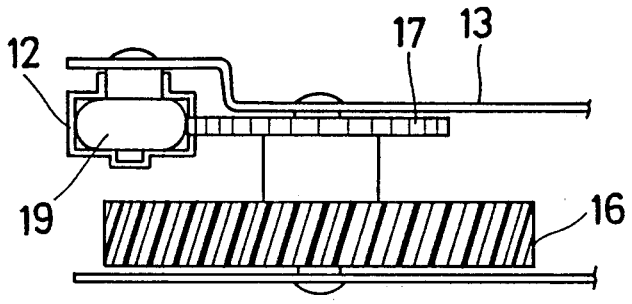
FIG. 3 is a view similar to FIG. 2, however taken along the line III—III in FIG. 1.
Figure 4:
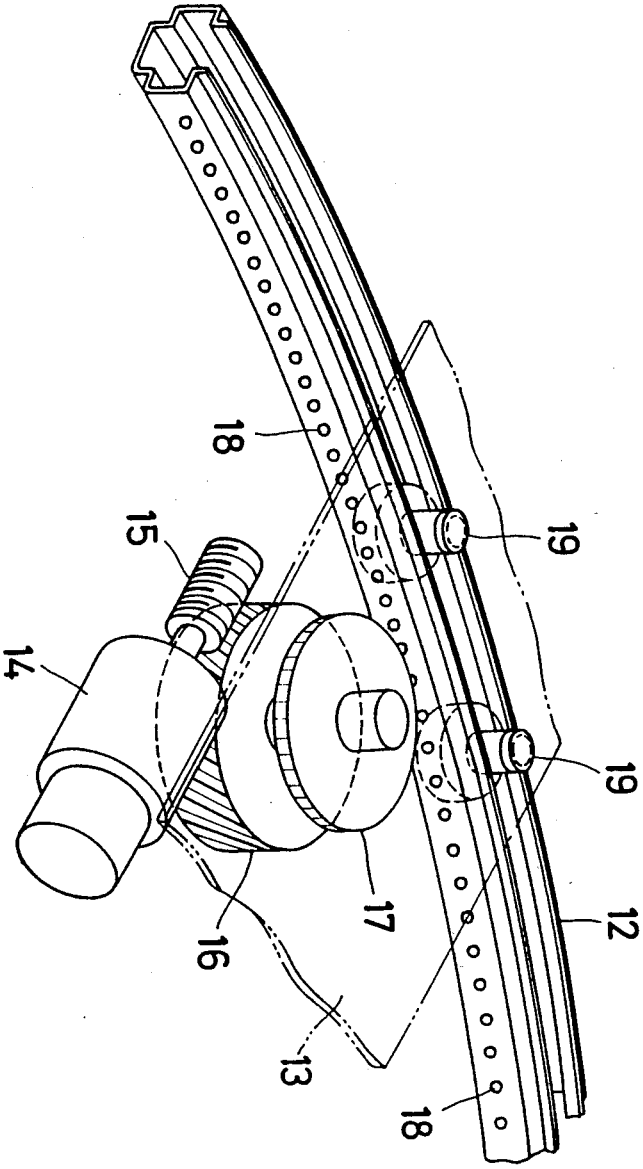
FIG. 4 is a perspective view of the power window regulating device of the present invention.
Figure 5:
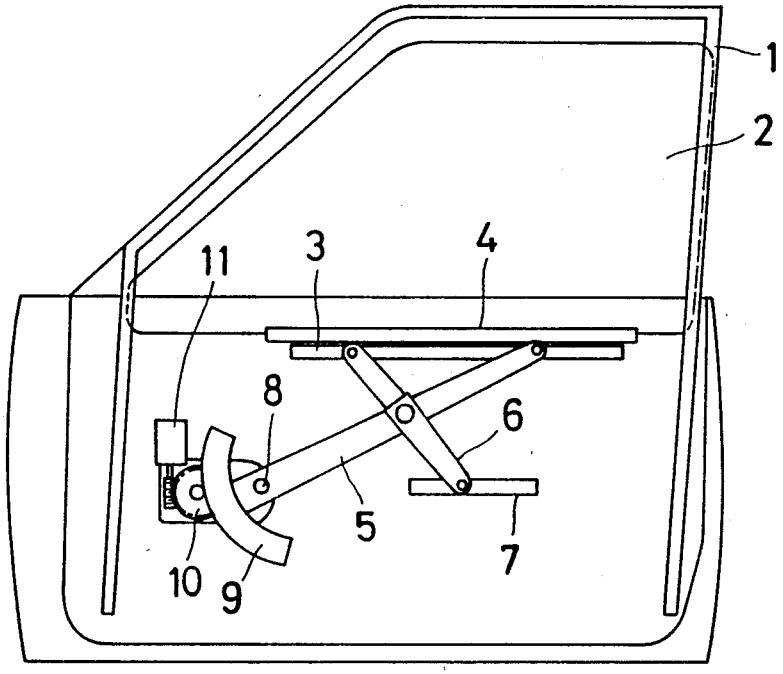
Fig. 5 (Prior Art)
FIG. 5 is a front view of a conventional power window regulating device.

Referring to FIG. 4, a window glass 2 is slidably fitted to a door frame 1. A guide member 12 is vertically extended and is fixed to the center of the door. A bracket 13 is fixed to a lower portion of the window glass 2. An electric motor 14 is mounted on the bracket 13. A speed reduction member includes a worm gear 15, a worm wheel 16, and a plane gear 17.

The plane gear 17 is engaged with recesses 18 on the wall of the guide member 12. Shoes 19 are rotatably pivoted on the bracket 13 and is located in a space of the guide member 12. The shoes 19 attain the up- and downward movement of the window glass 2 along the gide member 12. When the motor 14 is switched on, the motor 14 is rotated and the rotation of the motor 14 is transmitted to the plane gear 17 through the worm gear 15 and the worm wheel 16 by the speed reduction. The plane gear 17 is engaged with the guide 12, so that the bracket 13 is up- and downwardly moved along the guide member 12 by the rotation of the plane gear 17. As this result, the window glass 2 is opened and closed.

By the foregoing, there has been disclosed a preferred form of a power window regulating device constructed in accordance with the present invention. It will be appreciated by those skilled in the art that various additions, substitutions, modifications and omissions may be made to the invention without departing from the spirit or scope of the invention.

What is claimed is:

1. A device for power regulating the opening and closing, along a predetermined path, a window installed within a vehicular body between spaced sidewalls defining a predetermined body thickness, the device comprising:

a bracket fastened to a lower edge portion of the window, the bracket having a planar sheet configuration portion extending below the lower edge portion in a plane substantially corresponding to an extension of the window and spaced laterally between the body sidewalls;

an elongate guide member mounted between and spaced from the body sidewalls, the guide member having spaced opposed walls joined by a common wall, the opposing and common walls defining a channel extending along and corresonding to the predetermined path, the guide member having a slot opposite the common wall and a plurality of spaced recesses along one of the opposing walls, the one opposing wall lying in a plane substantially normal to the plane of the sheet bracket and the window;

a pair of spaced rollers rotatably mounted on the planar sheet configuration portion of the bracket adjacent one surface of the bracket and movably disposed in the channel on spaced axes extending through the slot;

a shaft rotatably mounted on the planar portion of the bracket and extending axially from the one surface normal to the planar sheet portion of the bracket; the shaft being laterally spaced a predetermined distance from the roller means axes and positioned longitudinally between the spaced roller means axes, a plane gear having peripheral projections corresponding to the recesses fixedly mounted to the shaft, the gear having a planar radial surface parallel to the planar sheet portion of the bracket and the projections engaging the recesses of the one wall of the bracket between the roller axes;

a reduction gear fixedly mounted on the shaft; and driving means including a motor mounted to the bracket adjacent the one surface of the planar sheet portion in engagement with the reduction gear.

2. The device of claim 1 wherein the planar sheet portion of the bracket has a thickness less than the thickness of the window.

3. The device of claim 1 wherein the recesses in the wall of the guide member are holes spaced equidistantly from each other.

4. The device of claim 1 wherein the reduction gear is a worm wheel and the driving means is a worm gear fixed to the motor.

5. The device of claim 2 wherein the reduction gear is axially spaced form the plane gear and is laterally spaced from and intersects the extended plane of the one wall of the guide member.

6. The device of claim 2 wherein the recesses in the one wall of the guide member are equidistantly spaced holes and the projections on the plane gear are projections spaced to fit in the holes of the one wall between the pair of rollers.

* * * * *